US006630038B1

(12) United States Patent
Ninomiya

(10) Patent No.: US 6,630,038 B1
(45) Date of Patent: Oct. 7, 2003

(54) PROCESSING APPARATUS FOR FORMING METALLIC MATERIAL

(75) Inventor: Susumu Ninomiya, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/587,060

(22) Filed: Jun. 2, 2000

(30) Foreign Application Priority Data

Jun. 3, 1999 (JP) ..... 11-156827

(51) Int. Cl.[7] ..... C21D 1/58
(52) U.S. Cl. ..... 148/637; 266/113; 266/120
(58) Field of Search ..... 266/44, 107, 120, 266/113; 148/637; 219/635, 651

(56) References Cited

U.S. PATENT DOCUMENTS

| | | | | |
|---|---|---|---|---|
| 2,797,177 A | | 6/1957 | Keller | |
| 3,174,491 A | * | 3/1965 | Faler | 134/102 |
| 3,256,119 A | | 6/1966 | Logan et al. | |
| 3,430,680 A | | 3/1969 | Leghorn | |
| 3,552,404 A | * | 1/1971 | Kuhn | 134/2 |
| 3,845,805 A | | 11/1974 | Kavesh | |
| 4,618,379 A | * | 10/1986 | Bruno et al. | 148/144 |
| 6,492,631 B2 | * | 12/2002 | Ninomiya | 219/635 |

FOREIGN PATENT DOCUMENTS

| | | |
|---|---|---|
| DE | 35 05 689 | 8/1986 |
| EP | 1057897 A2 * | 6/2000 |
| JP | 58 224120 | 12/1983 |

OTHER PUBLICATIONS

Keller, J.D., "Continuous Annealing In Molten Sodium", Iron and Steel Engineer, (Nov. 1959), pp 125–133.

* cited by examiner

*Primary Examiner*—Scott Kastler
(74) *Attorney, Agent, or Firm*—Foley & Lardner

(57) ABSTRACT

A processing apparatus forms a metallic material such as steel. The apparatus includes a heating tub, spray nozzles, a cooling tub, and a circulator. The heating tub heats the steel to equal to or higher than the modification point of the steel. The spray nozzles cool the steel processed by the heating tub to lower than the modification point, by contacting liquid metal sodium onto the steel. The cooling tub stores the liquid metal sodium, soaks the steel processed by the spray nozzles, and cools the steel. The circulator 20 circulates the liquid metal sodium so that the liquid metal sodium flows in the same direction as the steel in the cooling tub 3.

21 Claims, 6 Drawing Sheets

PROCESSING APPARATUS FOR FORMING METALLIC MATERIAL

BACKGROUND

1. Field of the Invention

The present invention relates to a processing apparatus for forming a metallic material, and more particularly to a processing apparatus capable of improving characteristics of the metal.

2. Description of the Related Art

Metallic materials characteristics change depending on the metal formation process, and component adjusting process is applied as well as heating, cooling, and rolling processes to control those characteristics.

In the case of heating and cooling, crystal, particle diameter of crystal, component distribution of crystal and the like, that depend on characteristics of steel and wires, can be changed by controlling heating patterns and cooling patterns. Among them, considering temperature of cooling patterns when it crosses modification point of metallic material is more important. Further, increasing the cooling speed decrease the crystal particle size and structure of metallic materials, and thereby improves strength and toughness of metallic materials.

It is also known that increasing the cooling speed decrease the crystal particle size, and structure of metallic materials, when molten metals solidify. Especially, rapid cooling forms amorphous metals. Consequently, selecting a cooling process and a coolant for each purpose is important to obtain materials having the required characteristics.

As for coolants, gases, vapor, mist, cold water, distilled water, molten salt, lead, tin, and the like are usually used in order to spray, like a jet, directly onto metallic materials or to store into a container to soak metallic materials.

Other cooling methods are also proposed such that metallic materials are contacted on a metallic coolant roller, and the metallic materials are soaked in liquid metal sodium.

To explain specifically about the heating/cooling process employing liquid metal sodium as a coolant, it is used in a continuous annealing apparatus for the purpose of cooling steel. Therefore, the primary purpose of employing the liquid metal sodium in this annealing apparatus is to exchange heat or to save energy. In this case, the liquid metal sodium is cooled when the steel is in a heating process, and the liquid metal sodium is heated when the steel is in a cooling process, known as counter-flow type heat exchanger. This steel and the liquid metal sodium move in opposite direction. As is obvious from the temperature transition pattern illustrated in FIG. 1, the conventional process aiming heat exchange cannot produce a large temperature difference ($\Delta T$) between the temperature of steel and the temperature of liquid metal sodium. Thereby, there is a certain limit on cooling speed to form metallic material having required characteristic. Liquid metal sodium is difficult to work with. For example, it explodes on contact with water. Therefore, the use of liquid metal sodium has been reserved for critical applications such as in nuclear power plants.

SUMMARY OF THE INVENTION

The present invention has been made in view of the above-mentioned circumstances and is intended to solve the above-mentioned problems. In particular, one purpose of the present invention is to provide a processing apparatus for forming a metallic material capable of providing a metallic material having minute crystal particles and structure. Another purpose of the present invention is to provide a processing apparatus for a metallic material capable of forming amorphous metals from metallic materials.

Additional purposes and advantages of the invention will be apparent to persons skilled in this field from the following description, or may be learned by practice of the invention.

The present invention provides a processing apparatus for forming a metallic material, including: a metallic material heater that heats the metallic material to equal to or higher than the modification point thereof; and a liquid metal sodium supplier that cools the metallic material processed by the metallic material heater to lower than the modification point, by contacting a liquid metal sodium onto the metallic material, wherein the liquid metal sodium flows in the same direction as the metallic material.

In accordance with one aspect of the present invention, the apparatus may further include a cooling tub that stores the liquid metal sodium and soaks the metallic material processed by the liquid metal sodium supplier therein so as to cool the metallic material, and a liquid metal sodium circulator that circulates the liquid metal sodium in the cooling tub. In this case, the apparatus may further include an inert gas spray that sprays inert gas onto the metallic material processed by the cooling tub to remove liquid metal sodium on the metallic material.

The liquid metal sodium may be isolated in a space filled with an inert gas. The cooling tub may be constituted so that the liquid metal sodium supplied from the liquid metal sodium supplier collects in the cooling tub.

The liquid metal sodium circulator may further include an inhalant tube that inhales the liquid metal sodium from a portion adjacent to where the metallic material is pulled out from the cooling tub, an impurity remover that removes impurities from the liquid metal sodium inhaled by the inhalant tube, a liquid metal sodium cooler that cools the liquid metal sodium from which the impurities are removed, and an exhaust tube that returns a cooled liquid metal sodium to the liquid metal sodium supplier.

The metallic material heater may include a heating tub that soaks the metallic materials so as to heat the metallic material.

The metallic material heater may include a melting pot that stores the metallic material in liquid condition. The molten metallic material flows onto a cooling roller that can be rotated, and the liquid metal sodium supplier supplies the liquid metal sodium to the molten metallic material on the cooling roller. In this case, the metallic material thus processed may be an amorphous metal.

The apparatus may include a roller, upstream of the metallic material heater or downstream of the liquid metal sodium supplier, for rolling the metallic material.

The present invention further provides a method for processing a metallic material, including the steps of: heating a metallic material to equal to or higher than the modification point thereof; and cooling the heated metallic material to lower than the modification point, by contacting a liquid metal sodium onto the metallic material, wherein the liquid metal sodium flows in the same direction as the metallic material.

Further purposes, features and advantages of the invention will become apparent from the detailed description of preferred embodiments that allows, when considered together with the accompanying figures of drawings.

BRIEF DESCRIPTION OF DRAWINGS

The accompanying drawings, which are incorporated in and constitute a part of this, specification, illustrate several preferred embodiments of the invention and, together with the description, serve to explain the principles of the invention.

DESCRIPTION OF PREFERRED EMBODIMENTS

Preferred embodiments of a processing apparatus for a metallic material of the present invention will now be specifically described in more detail with reference to the accompanying drawings. Wherever possible, the same reference numbers will be used throughout the drawings to refer to the same or like parts.

First Embodiment

In a first embodiment, a plate-like metallic material is used to explain as an example. However, a bar-like metallic material, a wire-like metallic material, and the like can also be employed to this embodiment.

Figure 1:
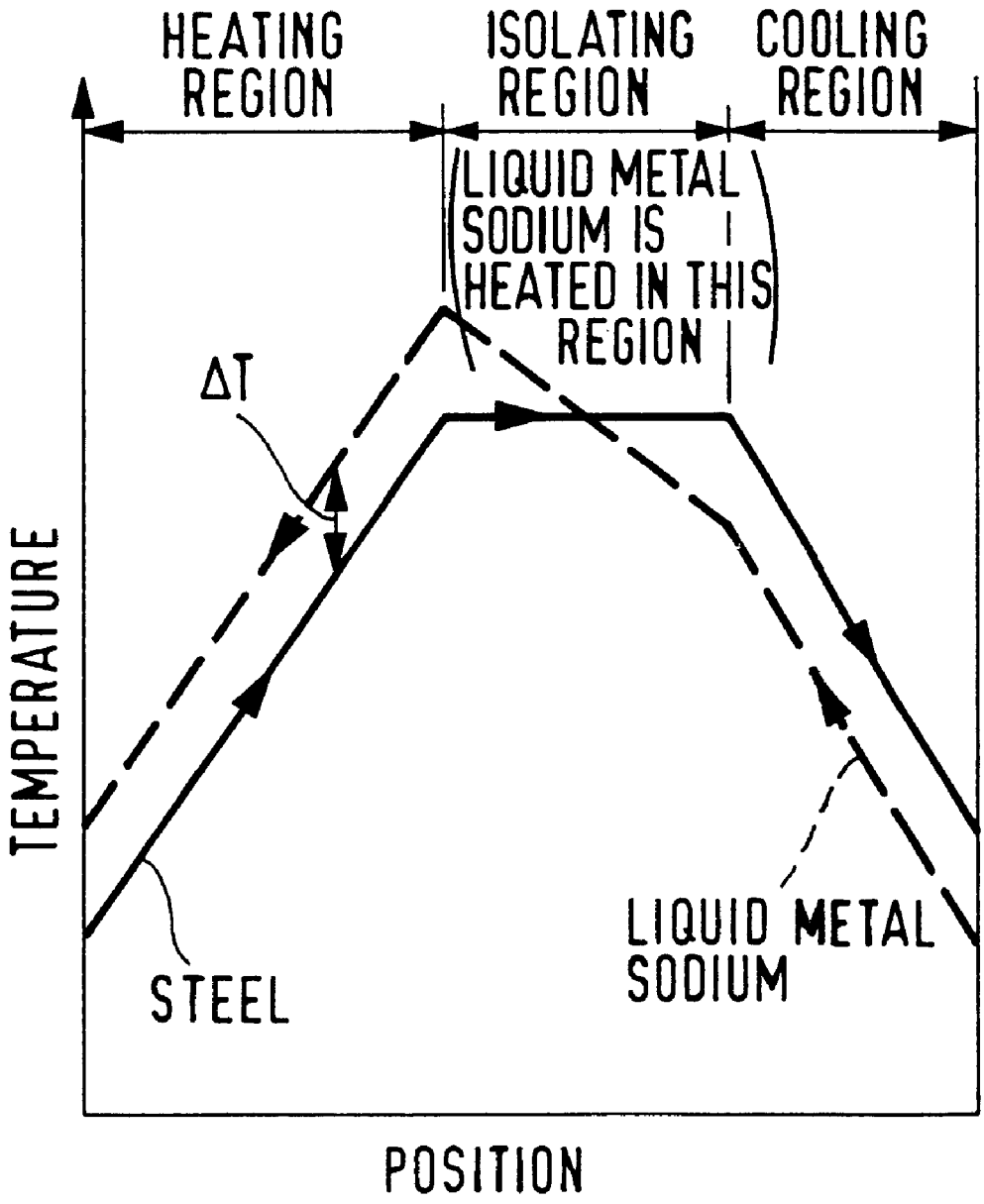
Fig. 1 (PRIOR ART)
FIG. 1 is a graph showing the temperature transition of a steel plate and liquid metal sodium in a conventional continuous annealing machine, when liquid metal sodium heats and cools the steel plate.
Figure 2:
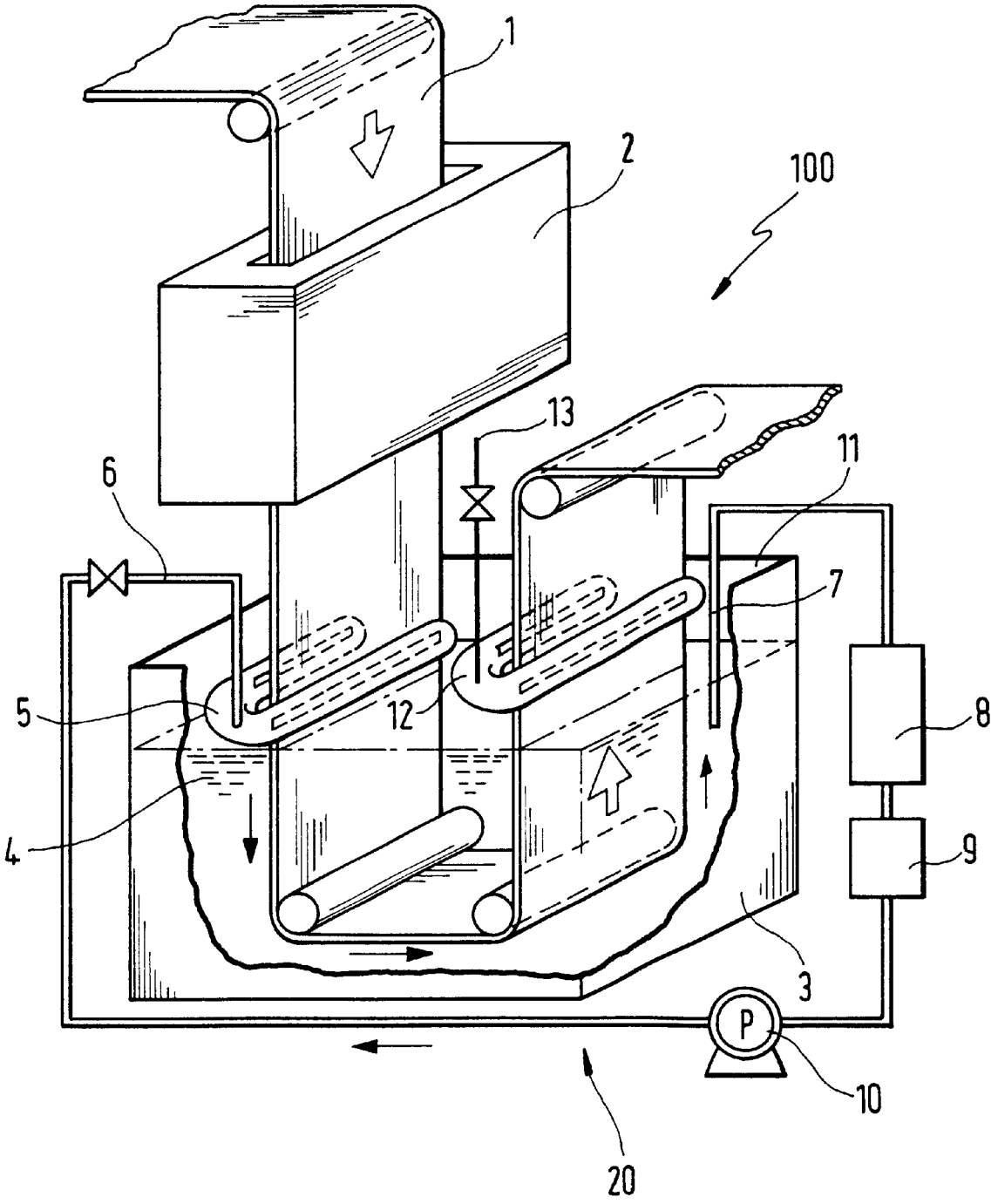
FIG. 2 is a perspective view showing a processing apparatus for a metallic material according to a first embodiment of the present invention.

A processing apparatus for metallic materials according to the first embodiment executes a heating process and a cooling process for a continuously supplied metallic material. As shown in FIG. 2, the processing apparatus 100 includes a heating tub 2 as a metallic material heater. This heating tub 2 can heat steel 1, which is one example of the metallic materials, to or above its modification point. That is, the heating tub 2 can heat the steel 1 to a temperature more than 700° C.

The processing apparatus 100 also includes spray nozzles 5 as a sodium supplier and a cooling tub 3. The spray nozzles 5 can spray liquid metal sodium onto the steel 1 heated by the heating tub 2, thereby cooling the steel 1 rapidly. The cooling tub 3 holds the liquid metal sodium 4, and the steel 1 cooled rapidly by the spray nozzles 5 is further cooled while moving under the liquid metal sodium 4 in the cooling tub 3.

Gas spray nozzles 12, as an inert gas spray device, are disposed so as to remove liquid metal sodium on the steel 1 pulled out from the cooling tub 3, by spraying inert gas onto the steel 1. An inert gas supply tube 13 is connected to the gas spray nozzles 12.

A liquid metal sodium circulator 20 circulates liquid metal sodium 4 in the cooling tub 3. This circulator 20 is controlled so that the liquid metal sodium 4 in the cooling tub 3 flows in the same direction as the steel 1 moves.

More specifically, the circulator 20 is equipped with an inhalant tube 7, a liquid metal sodium cooler 8, an impurity remover 9, an exhaust tube 6, and a circulation pump 10. The inhalant tube 7 inhales the liquid metal sodium 4 from the portion adjacent to where the steel 1 is pulled out from the cooling tub 3. The liquid metal sodium cooler 8 cools the liquid metal sodium 4 inhaled from the inhalant tube 7. The impurity remover 9 removes impurities from the liquid metal sodium 4. The exhaust tube 6 returns the liquid metal sodium 4, which was cooled and impurity-removed, to the spray nozzles 5. The circulation pump 10 circulates the liquid metal sodium 4 from the inhalant tube 7 to the exhaust tube 6.

Above the liquid metal sodium 4 in the cooling tub 3, there is a space 11 filled with an inert gas such as nitrogen, argon, and the like. The space 11 is isolated from atmosphere by a lid (not shown), however, the lid has an entrance and an exit which allow only the steel 1 to pass through.

Hereinafter, a method of providing the steel 1 having minute structure, by employing a heating and a cooling processes, will be explained.

First, the steel 1 is heated in the heating tub 2 up to a predetermined temperature higher than 700° C. Afterwards, the steel 1 is soaked into the cooling tub 3, and the cooled liquid metal sodium 4 from the spray nozzles 5 is sprayed onto the steel 1 so that the steel 1 is cooled.

Here, the liquid metal sodium 4 is in liquid phase whose temperature is in the range of 98° C. to 886° C. Therefore, a vapor film of the liquid metal sodium 4 is not formed on the steel 1, even though the liquid metal sodium 4 contacts the steel 1 which is over 700° C. Thereby, heat conductivity thereof can be maintained properly.

The temperature of the liquid metal sodium 4 cooled by the liquid metal sodium cooler 8 takes the lowest value, and the temperature of the steel 1 heated by the heating tub 2 takes the highest value. Therefore, the difference of temperature between the steel 1 and the liquid metal sodium 4 at the position of the spray nozzles 5 obtains the maximum value.

As is explained above, by spraying the liquid metal sodium 4 onto the steel 1, a large cooling speed such as more than 10,000° C. per second can be achieved thereby cooling rapidly to less than 300° C.

Figure 3:
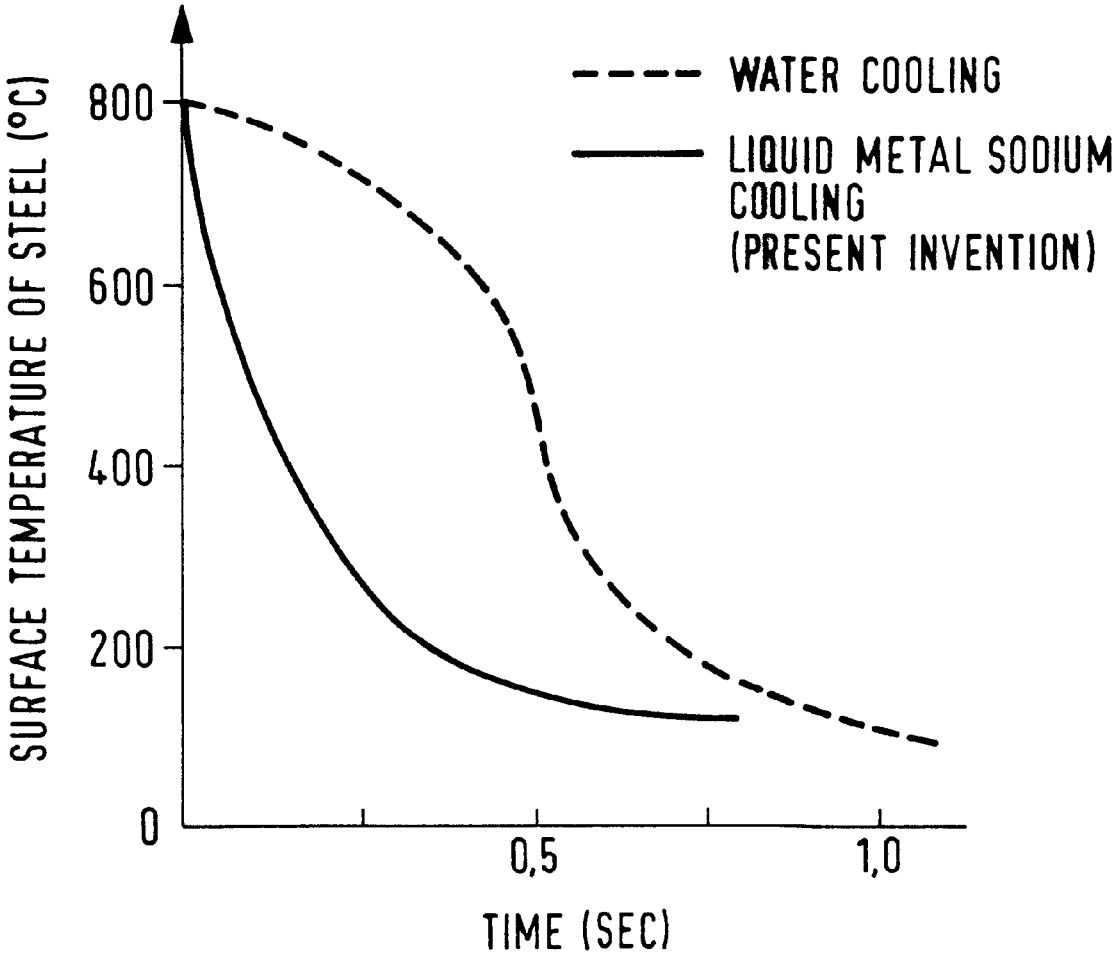
FIG. 3 is a graph showing the surface temperature transition of a steel plate when liquid metal sodium or water is sprayed on the steel plate at 800° C.

FIG. 3 is a graph showing surface temperature transition of the steel 1, when liquid metal sodium 4 or water is sprayed on the steel 1 at 800° C.

Here, a solid line in the figure represents the case using the liquid metal sodium as a coolant (present invention), and the dotted line represents the case using water as a coolant (conventional method). As is obvious from FIG. 3, a remarkable difference in cooling speed in the range of 600° C. to 800° C. can be recognized.

Figure 4:
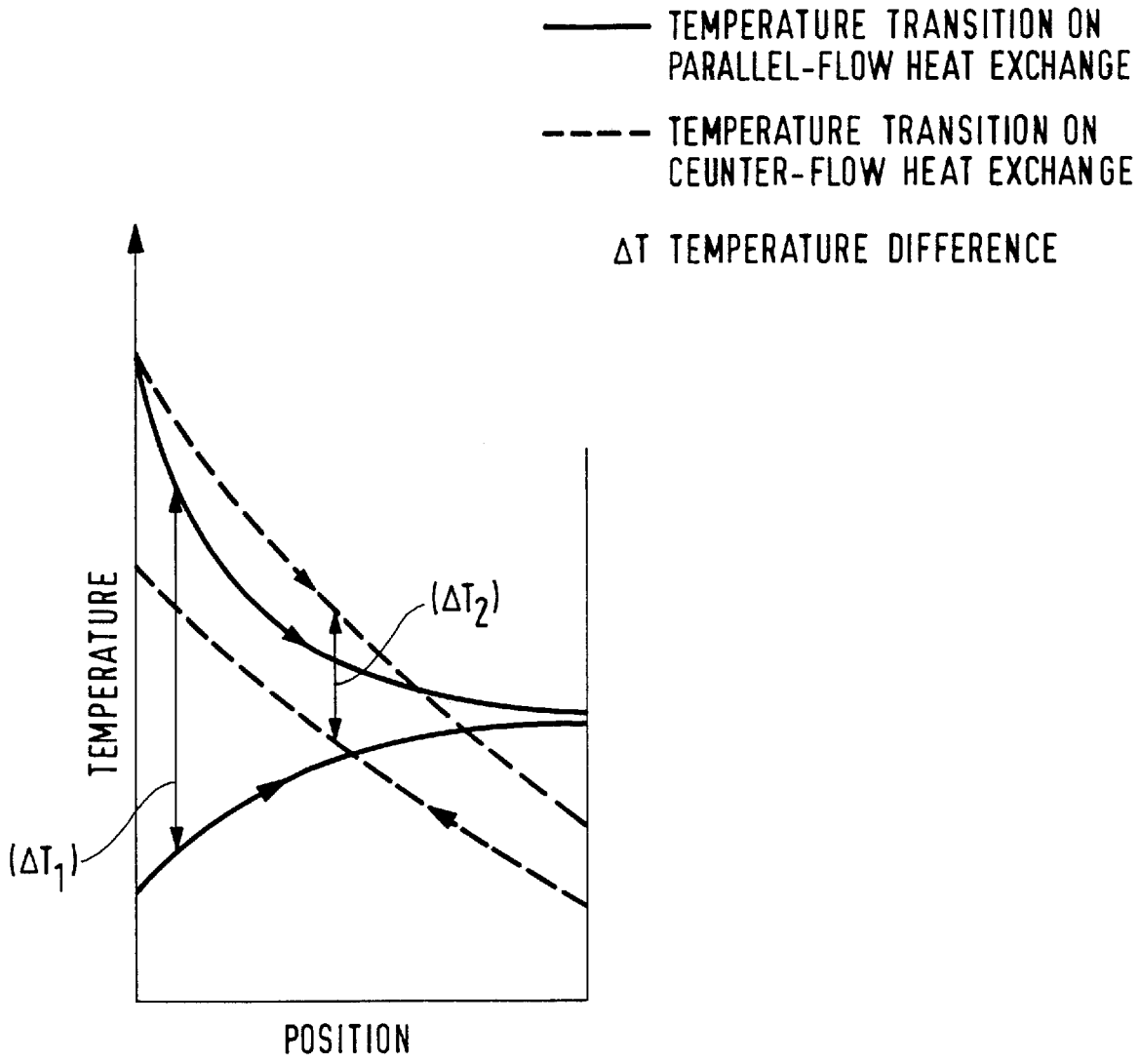
FIG. 4 is a graph showing temperature transitions of two liquids in different temperatures regarding two heat exchange types: a parallel-flow type in which the two liquids flow in the same direction, and a counter-flow type in which the two liquids flow in the opposite directions.

In the present invention, the liquid metal sodium 4 in the cooling tub 3 flows in the same direction as the steel 1 moves. This allows the temperature transitions of the steel 1 and the liquid metal sodium 4 to follow the solid line in FIG. 4; that is, a parallel-flow heat exchange pattern. This pattern makes it possible to obtain a larger temperature difference ($\Delta T1$) than the temperature difference ($\Delta T2$) of a counter-flow type heat exchange pattern.

Hence, the steel 1 having a temperature equal to or higher than the modification point, for example, higher than 700° C.

can be rapidly cooled down to a temperature lower than the modification point. Therefore, the structure of the steel 1 can be minute. Specifically, the steel 1 having crystal particles whose diameters are changed between 1 micrometer to 10 micrometers is achieved.

Inert gas is sprayed onto the steel 1 at the position where the steel 1 is pulled out from the liquid metal sodium 4 and is in the space 11 filled with an inert gas. The liquid metal sodium 4 on the steel 1 is removed and then the steel 1 is moved to an atmosphere. According to this process, the liquid metal sodium 4 is not transferred from the cooling tub 3 to an atmosphere and thereby avoids combustion.

As is explained above, the liquid metal sodium 4, which is supplied by the spray nozzles 5 and stored in the cooling tub 3, flows in the same direction as the steel 1 moves and is collected by the inhalant tube 7 apart from the spray nozzles 5. Because the temperature of the liquid metal sodium 4 becomes higher due to heat exchange with the steel 1, the liquid metal sodium 4 is cooled by the liquid metal sodium cooler 8. After removing impurities such as oxide, hydroxide, carbide, and the like, by the impurity remover 9, and pressurizing by the circulating pump 10, the liquid metal sodium 4 is supplied to the cooling tub 3 from the exhaust tube 6.

Note that a fat arrow in FIG. 2 represents the movement direction of the steel 1, and a thin arrow represents the flow direction of the liquid metal sodium.

In the present invention, the steel 1, that is heated to equal to or higher than modification point thereof, is then cooled down to less than modification point in a moment by the sprayed liquid metal sodium 4. Therefore, the structure of the steel 1 can be minute and thereby improving strength and toughness of the steel 1. In the conventional method, a steel having a diameter of 10 micrometer to 100 micrometer was obtained, however, in the present invention, a steel having 1 micrometer to 10 micrometer diameter can be achieved.

The liquid metal sodium 4 is made of sodium, therefore, the liquid metal sodium 4 can be obtained easily. The waste thereof can be treated as drainage by using hydrochloric acid as neutralizing agent, thereby avoiding environmental pollution. The liquid metal sodium 4 has activated characteristic and combines with impurities such as oxygen, hydrogen, carbon, and the like. Therefore, scales, which are usually made by oxide etc., are not generated even if the liquid metal sodium 4 contacts the steel 1. This makes it possible to omit a scale remover, which was usually necessary for this kind of apparatus, and to improve economical advantages. Any chemicals for the scale remover can also be avoided;

therefore, environmental pollution can be prevented similarly in this point of view.

According to the first embodiment of the present invention, the liquid metal sodium 4 in the cooling tub 3 flows in the same direction as the steel 1 moves. This means that the temperature transition for the steel 1 and the liquid metal sodium 4 are identical to the parallel-flow heat exchange type. In this type, the temperature difference ($\Delta T1$) can take larger values than the temperature difference ($\Delta T2$), thereby achieving the steel 1 having minute structure.

Second Embodiment

Figure 5:
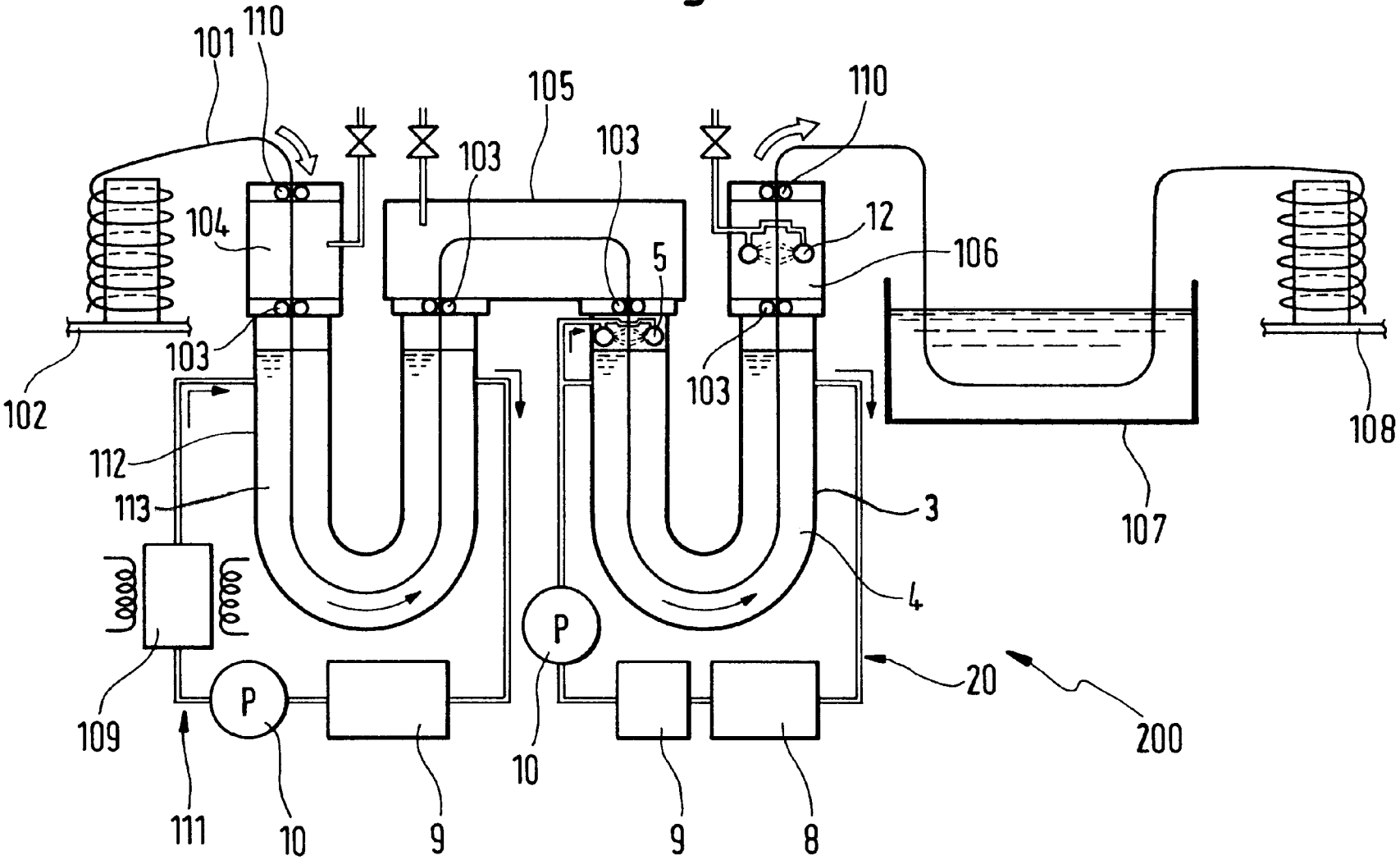
FIG. 5 is a diagram showing a processing apparatus for a metallic material according to a second embodiment of the present invention.

A processing apparatus for metallic materials according to a second embodiment is explained by referring to FIG. 5. In this embodiment, a wire-like metallic material is used to explain as an example, however, a plate-like metallic material, a bar-like metallic material, and the like can also be employed in this embodiment.

As shown in FIG. 5, the process apparatus 200 according to the second embodiment includes two tubs, that is, a heating tub 112, as a metallic material heating device, and the cooling tub 3. Similar to the previous embodiment, the cooling tub 3 holds liquid metal sodium 4 for cooling purpose, and the liquid metal sodium 4 flows, by the liquid metal sodium circulator 20, in the same direction as a wire 101 moves in the cooling tub 3.

The circulator 20 is equipped with the liquid metal sodium cooler 8, the impurity remover 9, and the circulation pump 10. The liquid metal sodium 4 that has minimum temperature cooled by the cooler 8 is sprayed on the wire 101 by the spray nozzles 5.

The cooling tub 3 has a U-shaped section, and seal rollers 103 are disposed in each end of the cooling tub 3 where the wire 101 enters into or exits from. On the seal roller 103 on the exit side of the cooling tub 3, there is provided an exit space 106 filled with an inert gas. The gas spray nozzles 12 are disposed in the exit space 106. The exit space 106 is isolated from atmosphere-by another seal roller 110, and the condition in the exit space 106 is controlled by an inert gas.

In the lower stream of the exit space 106, a washing tub 107 and a winding device 108 are arranged. The washing tub 107 holds water or a neutralization washing agent. The winding device 108 winds up the wire 101 which is processed.

The heating tub 112 according to the second embodiment holds liquid metal sodium 113 for heating purpose, which has temperature equal to or higher than the modification point of the wire 101. The liquid metal sodium 113 in the heating tub 112 is circulated and heated by a liquid metal sodium circulator 111.

The circulator 111 includes a liquid metal sodium heater 109, the impurity remover 9, and the circulating pump 10. The liquid metal sodium heater 109 heats the liquid metal sodium 113 which is exhaust near the portion where the wire 101 is pulled out. The impurity remover 9 removes impurities from the liquid metal sodium 113. The circulation pump 10 circulates the liquid metal sodium 113, which was heated and impurity-removed, to the entrance side of the heating tub 112.

The heating tub 112 has a U-shaped section, and seal rollers 103 are disposed in each end of the heating tub 112 where the wire 101 enters into or exits from. On the seal roller 103 on the exit side of the heating tub 112, there is provided an entrance space 104 filled with an inert gas. The entrance space 104 is isolated from atmosphere by another seal roller 110, and the condition in the entrance space 104 is controlled by an inert gas.

In the upper stream of the seal roller 101, which is located next to the entrance space 104, a spindle device 102 stores the wire 101 which is unprocessed.

Moreover, a thermal insulating tub 105 is disposed between the heating tub 112 and the cooling tub 3. This thermal insulating tub 105 is connected to the exit of the heating tub 112 and the entrance of the cooling tub 3 by the seal rollers 103 in between. The inside of the thermal insulating tub 105 is insulated from atmosphere and is controlled by an inert gas. Thereby, temperature of the inert gas can be controlled in order to keep the temperature of the wire 101 through the thermal insulating tub 105 constant.

Hereinafter, a method of miniaturizing the structure of the wire, which is done by heating and cooling, by using the processing apparatus of the second embodiment, will be explained.

First, the wire 101 supplied by the spindle device 102 is guided to the heating tub 112 through the entrance space 104. The wire 101 contacts the liquid metal sodium 113 directly and is heated up to a certain temperature by a way of heat exchanging. The wire 101 is then guided to the thermal insulating tub 105, and the temperature thereof is kept constant in a predetermined period.

Afterwards, the wire 101 enters the cooling tub 3 and is cooled down rapidly by the liquid metal sodium 4 sprayed from the spray nozzles 5. Here, the liquid metal sodium 4 sprayed has the lowest temperature in the circulation. The wire 101 is then soaked in the liquid metal sodium 4 in the cooling tub 3 and the temperature thereof is kept constant for a predetermined period.

The wire 101 processed by the cooling tub 3 is guided into the exit space 106, and any liquid metal sodium on the wire 101 is removed by the inert gas sprayed from the spray nozzles 12. The wire 101 passed through the exit space 106 is then guided to the washing tub 107. Desiccating process are made after the washing process in the washing tub 107, and finally, the wire 101 is wound in the winding device 108.

Heat exchange is made between the liquid metal sodium 112 in the heating tub 113 and the wire 101. The liquid metal sodium 113 cooled by this heat exchange process is removed from the heating tub 112, and guided to the impurity remover 9, the circulating pump 10, and the liquid metal sodium heater 112. The liquid metal sodium 113 in the heater 112 is heated up to a certain temperature and supplied to the heating tub 112 continuously. On the other hand, the liquid metal sodium 4 in the cooling tub 3 deprives the wire 101 of heat and is removed from the cooling tub 3. The liquid metal sodium 3 is then guided to the liquid metal sodium cooler 8, impurity remover 9, and the circulating pump 10, and is returned to the cooling tub 3 again. The liquid metal sodium 3 is also used continuously.

In this embodiment, the entrance space 104 is arranged on the entrance side of the heating tub 112 so that the liquid metal sodium 113 does not, for safety reasons, to contact the atmosphere. Accordingly, even if the liquid metal sodium 113 or the vapor thereof leaks from the heating tub 112, it is collected safely in the entrance space 104.

Liquid metal sodium 4 can cling to the wire 101 when it is guided from the exit of the heating tub 112 to the entrance of the cooling tub 3. However, the thermal insulating tub 105, which insulate atmosphere and is controlled by inert gas, is arranged in the place. Thereby, the wire 101 can be guided there safely without employing any spray nozzles.

According to the second embodiment, the same effect derived by the first embodiment can be achieved. Furthermore, in the second embodiment, the wire 101 is heated by the liquid metal sodium 113 used for heating purpose in the heating tub 112. This enables total heating devices to be smaller in size. In the second embodiment, any scale such as oxide on the wire 101 can be avoided in the heating process, thereby omitting a scale remover which was usually necessary for this kind of apparatus. Further, the liquid metal sodium 113 enables the wire 101 to heat in short time, thereby improving productivity of such wire 101.

Third Embodiment

Figure 6:
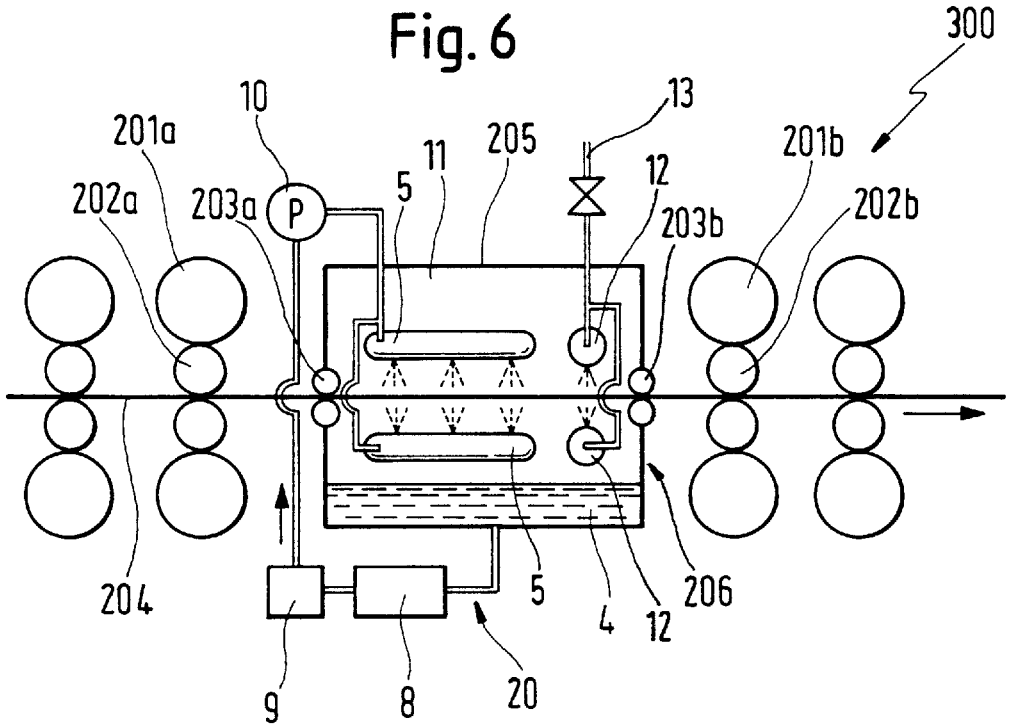
FIG. 6 is a diagram showing a processing apparatus for a metallic material according to a third embodiment of the present invention.

A processing apparatus for metallic materials according to a third embodiment is explained by referring to FIG. 6.

A processing apparatus 300 according to the third embodiment is constituted so that a metallic material such as a steel 204 is processed by a way of hot rolling and/or cold rolling while the steel 204 moves. As shown in FIG. 6, in the upper stream of movement of the steel 204, there are arranged upstream rollers 202*a* and support rollers 201*a*. In the lower stream of movement of the steel 204, there are arranged downstream rollers 202*b* and support rollers 201*b*.

Further, the processing apparatus 300 includes the spray nozzles 5 and the gas spray nozzles 12. The spray nozzles 5, which are disposed between the upstream rollers 202*a* and the downstream rollers 202*b*, can spray liquid metal sodium onto the steel 204, thereby cooling the steel 204 rapidly. The gas spray nozzles 12 can remove the liquid metal sodium 4 for cooling purpose on the steel 204 by spraying inert gas thereon. The inert gas supply tube 13 is connected to the gas spray nozzles 12.

Both the spray nozzles 5 and the gas spray nozzles 12 are insulated from atmosphere by a cooling chamber 206 having a lid 205. On both sides of the cooling chamber 206 in which the steel 204 is guided, there are disposed seal rollers 203*a* and 203*b*, respectively.

The liquid metal sodium circulator 20 in the processing apparatus 300 is equipped with the liquid metal sodium cooler 8, the impurity remover 9, and the circulation pump 10. The circulator 20 recovers the liquid metal sodium 4 collected in the lower part of the cooling chamber 206, and returns the liquid metal sodium 4, which was cooled and impurity-removed, to the spray nozzles 5.

Hereinafter, a method of providing the steel 204 having minute structure by employing heating and cooling processes, will be explained.

First, the steel 204 is guided into hot atmosphere such as a hot strip mill in order to be rolled to a predetermined thickness by the upstream rollers 202*a*. The steel 204 is then guided to the space 11 in the cooling chamber 206 through the seal roller 203*a*, and is cooled rapidly by the liquid metal sodium 4 sprayed from the spray nozzles 5.

The inert gas is sprayed onto both sides of the steel 204 from the gas spray nozzles 12 so that any liquid metal sodium 4 on the steel 204 is removed. The steel 204 is guided out from the space 11 through the seal rollers 203*b* and, as occasion demands, is rolled by the rollers 202*b* and is wound.

The liquid metal sodium 4 sprayed from the spray nozzles 5 is collected either in the lower part of the cooling chamber 206 or in a dump tank (not shown) connected to the cooling chamber 206 by a drain tube (not shown). The collected liquid metal sodium 4 is then cooled by the liquid metal sodium cooler 8, and impurities such as oxide, hydroxide, carbide, and the like are removed by the impurity remover 9. Finally, the liquid metal sodium 4 is pressurizing by the circulating pump 10 and supplied to the spray nozzles 5.

According to the third embodiment, the same effect derived by the first and the second embodiments can be achieved. Furthermore, because the steel 204 is rolled by the rollers 202*a* and/or 202*b* just before and/or after being cooled rapidly, crystal particles and structure of the steel 204 can be minute physically. Moreover, by applying strain energy to the steel 204, a number of crystal nuclei can be increased, thereby providing the steel 204 having minuter crystal particles and structure.

Fourth Embodiment

Figure 7:
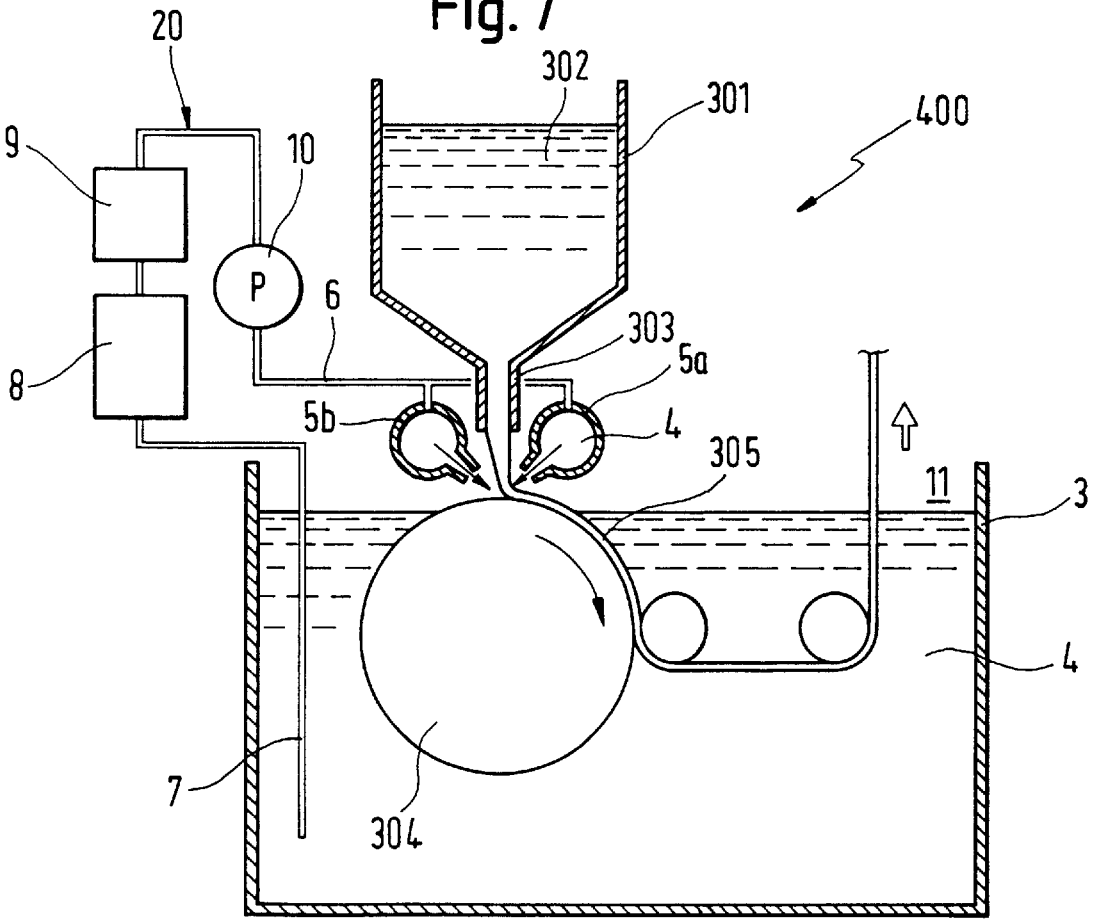
FIG. 7 is a diagram showing a processing apparatus for a metallic material according to a fourth embodiment of the present invention.

A processing apparatus for metallic materials according to a fourth embodiment is explained by referring to FIG. 7.

The processing apparatus 400 in the fourth embodiment is preferable to manufacturing amorphous metal. As shown in FIG. 7, the apparatus 400 includes a melting pot 301 and a cooling roller 304. The melting pot 301 stores molten metallic material 302, and the metallic material 302 flows out through an exit nozzle 303 on the melting pot 301 to the surface of the cooling roller 304. The cooling roller 304 is capable of rotating, and is soaked in the liquid metal sodium 4 in the cooling tub 3 except the upper tip portion thereof. Note that the melting pot 301 is constituted as a part of the metallic material heater which is not shown in FIG. 7.

The processing apparatus 400 includes first spray nozzles 5*a* and second spray nozzles 5*b*. The first spray nozzles 5*a* can spray the liquid metal sodium 4 directly onto one surface of the metallic material 305 being solidified on the cooling roller 304, thereby cooling the metallic material 305 rapidly. The second spray nozzles 5*b* can spray the liquid metal sodium 4 directly onto the cooling roller 304 and another surface of the metallic material 305 being solidified on the cooling roller 304, thereby cooling the metallic material 305 rapidly.

The liquid metal sodium circulator 20, which circulates the liquid metal sodium 4 in the cooling tub 3, is equipped with the inhalant tube 7, the liquid metal sodium cooler 8, the impurity remover 9, the exhalant tube 6 and, the circulation pump 10. The inhalant tube 7 inhales the liquid metal sodium 4 from the cooling tub 3. The liquid metal sodium cooler 8 cools the liquid metal sodium 4 inhaled from the inhalant tube 7. The impurity remover 9 removes impurities from the liquid metal sodium 4. The exhaust tube 6 returns the liquid metal sodium 4, which was cooled and impurity-removed, to the spray nozzles 5*a* and 5*b*. The circulation pump 10 circulates the liquid metal sodium 4 from the inhalant tube 7 to the exhaust tube 6.

Above the liquid metal sodium 4 in the cooling tub 3, the space 11 is filled with an inert gas such as nitrogen, argon, and the like. The space 11 is isolated from atmosphere by a lid (not shown); however, the lid has an entrance and an exit which allow only the metallic material 302 and 305 to pass through.

Hereinafter, a process for forming amorphous metallic materials continuously by the processing apparatus 400 according to the fourth embodiment will be explained. In the present invention, it makes possible to obtain a cooling velocity higher than about 10,000° C./s. However, in order to obtain amorphous metal, it requires faster cooling velocity such as 100,000 to 1,000,000° C./s, and the present invention enable to realize the cooling velocity.

The metallic material 302, which is molten in the melting pot 301, flows out through an exit nozzle 303 to the surface of the cooling roller 304. The metallic material 302 is cooled rapidly as soon as it contacts the cooling roller 304 and the liquid metal sodium 4 sprayed from the spray nozzles 5*a* and 5*b*. The metallic material 302 is soaked into the liquid metal sodium 4 in the cooling tub 3 as the cooling roller 304 rotates and is cooled to a certain temperature. The processed metallic material 302 is carried out from the cooling tub 3.

The liquid metal sodium 4 is inhaled by the inhalant tube 7 and is guided to the liquid metal sodium cooler 8 to be cooled. After that, impurities in the liquid metal sodium 4 are removed by the impurity remover 9. Then, the liquid metal sodium 4 is pressurized by the circulating pump 10 and is sprayed by the spray nozzles 5*a* and 5*b*.

According to this embodiment, the molten metallic material 302 is supplied onto the cooling roller 304, and the liquid metal sodium 4 is sprayed directly to both surface of the metallic material 302 on the cooling roller 304. Therefore, any vapor film, that deteriorates cooling performance of the metallic material 302, is not formed on the metallic material 302. Further, any scale on the metallic material 302 is also avoided so that chemicals for removing such scale are reduced.

Moreover, amorphous metal can be formed continuously to thicker plates and to wires that are hardly obtained by using conventional methods, and amorphous metal having minuter structure can be formed continuously.

As a modification to this embodiment, another rolling process that rolls solidified metallic material 305 can be employed in order to control and arrange structure and thickness of the metallic material 305.

According to this modification, the crystal particles in the solidified metallic material can be minute physically. Moreover, by applying strain energy to the metallic material, the number of crystal nuclei can be increased, thereby providing products having predetermined thickness and sizes as well as having minuter crystal particles and structure.

Fifth Embodiment

A processing apparatus for metallic materials according to a fifth embodiment is explained. In this embodiment, the molten metallic material is soaked in the liquid metal sodium so that the metallic material is rapidly cooled to be solidified in order to form amorphous metal. That is, to make reference to FIG. 7, the fifth embodiment is identical to the case that the molten metallic material 302 in the melting pot 301 is directly soaked into the liquid metal sodium 4 without contacting the cooling roller 305.

The direct contact of the molten metallic material with the liquid metal sodium is done by supplying the molten metallic material to the tub filled with liquid metal sodium, as stated above, or the liquid metal sodium is sprayed directly to the molten metallic material.

According to this embodiment, the liquid metal sodium is used to cool the metallic material. Therefore, any vapor film, that deteriorates cooling performance of the metallic material, is not formed on the metallic material. Further, any scale on the metallic material is also avoided so that chemicals for removing such scale are reduced. Similar to the fourth embodiment, this embodiment allows to form amorphous metal having minuter structure continuously.

As described above in detail, the present invention makes it possible to provide a metallic material having minute crystal particles and structure, by contacting a liquid metal sodium to the metallic material having temperature equal to or higher than its modification point so as to cool the metallic material down to temperature lower than the modification point rapidly.

The present invention also makes it possible to provide an amorphous metal, by contacting liquid metal sodium to the metallic material so as to cool and solidify the metallic material rapidly.

The foregoing discussion discloses and describes merely a number of exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting, of the scope of the invention, which is set forth in the following claims. Thus, the present invention may be embodied in various ways within the scope of the spirit of the invention.

What is claimed is:

1. A processing apparatus for forming a metallic material, comprising:

a metallic material heater that heats the metallic material to equal to or higher than the modification point thereof; and a liquid metal sodium supplier that cools the metallic material processed by the metallic material heater to lower than the modification point, by contacting liquid metal sodium onto the metallic material, wherein the liquid metal sodium flows in the same direction as the metallic material, and wherein the liquid metal sodium supplier comprises a spray nozzle arranged to spray the liquid metal sodium directly onto the metallic material.

2. A processing apparatus for forming a metallic material, comprising:

a metallic material heater that heats the metallic material to equal to or higher than the modification point thereof; and a liquid metal sodium supplier that cools the metallic material processed by the metallic material heater to lower than the modification point, by contacting liquid metal sodium onto the metallic material, a cooling tub that stores the liquid metal sodium and soaks the metallic material, and a liquid metal sodium circulator that circulates the liquid metal sodium in the cooling tub wherein the liquid metal sodium flows in the same direction as the metallic material, and wherein the liquid metal sodium supplier comprises a spray nozzle arranged to spray the liquid metal sodium directly onto the metallic material.

3. The processing apparatus according to claim 2, further comprising an inert gas spray that sprays inert gas onto the metallic material processed by the cooling tub to remove liquid metal sodium on the metallic material.

4. The processing apparatus according to claim 1, wherein the liquid metal sodium is isolated in a space filled with an inert gas.

5. The processing apparatus according to claim 2, wherein the liquid metal sodium supplied from the liquid metal sodium supplier collects in the cooling tub.

6. The processing apparatus according to claim 2, wherein the liquid metal sodium circulator further comprises an inhalant tube that inhales the liquid metal sodium from a portion adjacent to where the metallic material is pulled out from the cooling tub, an impurity remover that removes impurities from the liquid metal sodium inhaled by the inhalant tube, a liquid metal sodium cooler that cools the liquid metal sodium from which the impurities are removed, and an exhaust tube that returns a cooled liquid metal sodium to the liquid metal sodium supplier.

7. The processing apparatus according to claim 1, wherein the metallic material heater includes a heating tub that soaks the metallic materials so as to heat the metallic material.

8. A processing apparatus for forming a metallic material, comprising:

a metallic material heater that heats the metallic material to equal to or higher than the modification point thereof; and a liquid metal sodium supplier that cools the metallic material processed by the metallic material heater to lower than the modification point, by contacting liquid metal sodium onto the metallic material, wherein the liquid metal sodium flows in the same direction as the metallic material and wherein the metallic material heater includes a melting pot that stores the metallic material in molten condition, and the molten metallic material flows onto a cooling roller that can be rotated, and the liquid metal sodium supplier supplies the liquid metal sodium to the molten metallic material on the cooling roller.

9. The processing apparatus according to claim 1, further comprising a roller, disposed upstream of the metallic material heater or downstream of the liquid metal sodium supplier, for rolling the metallic material.

10. A method for processing metallic material, comprising the steps of:

heating a metallic material to equal to or higher than the modification point thereof; and cooling the heated metallic material to lower than the modification point, by contacting a liquid metal sodium onto the metallic material, wherein the liquid metal sodium flows in the same direction as the metallic material, and wherein the cooling step comprises spraying the liquid metal sodium directly onto the metallic material.

11. A method for processing metallic material, comprising the steps of:

heating a metallic material to equal to or higher than the modification point thereof; and cooling the heated metallic material to lower than the modification point, by contacting a liquid metal sodium onto the metallic material, soaking the cooled metallic material in a cooling tub that stores the liquid metal so as to cool the metallic material, and circulating the liquid metal sodium in the cooling tub, wherein the liquid metal sodium flows in the same direction as the metallic material, and wherein the cooling step comprises spraying the liquid metal sodium directly onto the metallic material.

12. The method according to claim 11, further comprising spraying an inert gas onto the metallic material processed by the soaking step in order to remove liquid metal sodium on the metallic material.

13. The method according to claim 10, wherein the liquid metal sodium is isolated in a space filled with an inert gas.

14. The method according to claim 10, wherein a cooling tub is constituted so that the liquid metal sodium supplied by the cooling step is collected to the cooling tub.

15. The method according to claim 11, wherein the circulating step further comprises inhaling the liquid metal sodium from a portion adjacent to where the metallic material is pulled out from the cooling tub, removing impurities from the liquid metal sodium processed by the inhaling step, and cooling the liquid metal sodium processed by the removing step in order to supply a cooled liquid metal sodium in the metallic material cooling step.

16. The method according to claim 10, wherein the metallic material heating step includes soaking the metallic materials in a heating tub so as to heat the metallic material.

17. A method for processing metallic material, comprising the steps of:

heating a metallic material to equal to or higher than the modification point thereof; and cooling the heated metallic material to lower than the modification point, by contacting a liquid metal sodium onto the metallic material, wherein the liquid metal sodium flows in the same direction as the metallic material, and wherein a melting pot that stores the metallic material in melting condition is employed in the heating step, and the molten metallic material flows onto a rotatable cooling roller, and the liquid metal sodium is supplied to the molten metallic material on the cooling roller in the cooling step.

18. The method according to claim 17, wherein the metallic material thus processed is an amorphous metal.

19. The method according to claim 11, further comprising rolling, prior to heating or after cooling, the metallic material.

20. A processing apparatus for forming a metallic material, comprising:

a metallic material heater that heats the metallic material to equal to or higher than the modification point thereof;

a liquid metal sodium supplier that cools the metallic material processed by the metallic material heater to lower than the modification point, by contacting a liquid metal sodium onto the metallic material; and a circulator for circulating the liquid metal sodium in the same direction as the metallic material wherein the liquid metal sodium supplier comprises a spray nozzle arranged to spray the liquid metal sodium directly onto the metallic material.

21. A method for processing metallic material, comprising the steps of:

heating a metallic material to equal to or higher than the modification point thereof;

cooling the heated metallic material to lower than the modification point, by contacting a liquid metal sodium onto the metallic material; and circulating the liquid metal sodium in the same direction as the metallic material wherein the cooling step comprises spraying the liquid metal sodium directly onto the metallic material.

* * * * *